United States Patent [19]

Mayer

[11] Patent Number: 5,034,867

[45] Date of Patent: Jul. 23, 1991

[54] FLUTED LAMP REFLECTOR

[75] Inventor: Mark J. Mayer, Boling Brook, Ill.

[73] Assignee: Blazer International Corporation, Franklin Park, Ill.

[21] Appl. No.: 548,379

[22] Filed: Jul. 5, 1990

[51] Int. Cl.[5] ..... F21V 7/00

[52] U.S. Cl. ..... 362/297; 362/61; 362/348

[58] Field of Search ..... 362/296, 297, 346, 347, 362/348, 61, 341

[56] References Cited

U.S. PATENT DOCUMENTS

| | | | |
|---|---|---|---|
| 1,621,585 | 3/1927 | Godley | 362/348 |
| 1,621,752 | 3/1927 | Raynolds | 362/348 |
| 1,639,363 | 8/1927 | Balsillie | 362/348 |
| 1,814,326 | 7/1931 | Melton | 362/297 |
| 2,274,405 | 2/1942 | Flaherty | 362/348 |
| 3,758,770 | 9/1973 | Morasz | 362/297 |
| 4,028,542 | 6/1977 | McReynolds, Jr. | 362/297 |
| 4,149,227 | 4/1979 | Dorman | 362/348 X |
| 4,293,900 | 10/1981 | Dziubaty | 362/342 |
| 4,447,865 | 5/1984 | VanHorn et al. | 362/305 |
| 4,494,176 | 1/1985 | Sands et al. | 362/297 |
| 4,905,133 | 2/1990 | Mayer et al. | 362/348 X |

*Primary Examiner*—Stephen F. Husar
*Assistant Examiner*—Peggy A. Neils
*Attorney, Agent, or Firm*—Willian Brinks Olds Hofer Gilson & Lione

[57] ABSTRACT

A fog lamp reflector includes a reflector body having a reflector surface made up of a series of vertical convex flutes. Each of the flutes is made up of a plurality of segments, and each of the segments is shaped as a section of a respective paraboloid. The focuses of all of the paraboloids substantially coincide at a selected point in space, and the segments of each flute are aimed at a plurality of non-parallel directions with the left-of-center segments of each flute aimed left of the central segment and the right-of-center segments of each flute aimed right of the central segment to laterally disperse reflected light originating at the selected point in space. The focal lengths of the paraboloids increase progressively from one side to the other side of at least some of the flutes, and the paraboloids are each scaled about their respective focus to ensure that adjacent segments meet on the midline of the reflector in a substantially continuous curve.

13 Claims, 6 Drawing Sheets

Section 4

Section 4

Section 4

FLUTED LAMP REFLECTOR

BACKGROUND OF THE INVENTION

This invention relates to a convexly fluted reflector for a lamp such as a fog lamp, wherein the reflector itself distributes light in a desired, non-colliminated pattern.

It has been proposed in the past to utilize fluted reflectors to achieve non-uniform light distribution in a lamp. For example, Basillie U.S. Pat. No. 1,639,363 discloses an automotive lamp reflector having a number of distinct surface regions, including vertical sections or flutes which project light laterally. As pointed out at page 2, lines 105–110 of Basillie, the cross section of these sections 8, 9 is different from that of the corresponding portion of the general or basic curvature upon which the reflector is designed, and this cross section may be somewhat convex. The stated purpose of the sections 8, 9 is to illuminate the sides of the roadway with light rays that are held comparatively close to the ground so as not to create glare in the eyes of the driver of an approaching vehicle. However, Basillie gives no guidance as to the shape to be given the individual sections 8, 9.

Doorman U.S. Pat. No. 4,149,227 discloses a dental surgical lighting reflector having an ellipsoidal surface divided into sections. These sections are individually concave in cross section, as shown in FIG. 6, and each concave section defines a respective ellipsoid. The ellipsoids are rotated outwardly with respect to one another as shown in FIG. 6 to spread the reflected light along one axis, thereby enlarging the illuminated area. As shown in FIG. 12, the rotated ellipsoids may have focuses that are offset slightly with respect to one another. Alternately, as shown in FIG. 13, the ellipsoidal surfaces may be recalculated to ensure that all of the focuses coincide. Note the discussion at columns 6 and 7, and in particular the discussion at column 6, line 59 through column 7, line 18. The Doorman patent utilizes ellipsoids rather than paraboloids, and therefore causes reflected light to converge at the conjugate focus, and to diverge thereafter in both the horizontal and vertical directions. This dispersion pattern is unsuitable for many vehicular lamps.

My earlier U.S. Pat. No. 4,805,133 describes a lamp which defines a reflective surface comprising a series of paraboloid strips arranged side by side along a lateral direction and including a central paraboloid strip. Each of the paraboloid strips defines a respective focus, and all of the focuses substantially coincide at a selected point in space. The paraboloid strips are aimed in a plurality of non-parallel directions to laterally disperse reflected light originating at the selected point in space. Each of the paraboloid strips defines a respective focal length, and the focal lengths of paraboloid strips progressively farther from the central paraboloid strip are progressively greater. The focuses are selected such that adjacent paraboloid strips are matched in position and the reflective surface is substantially continuous. The reflector body preferably extends over all four quadrants, and the entire reflective surface provides a visually smooth appearance, without flutes of any type.

Finally, it has also been suggested in the past to provide a fog lamp reflector with an array of convex vertical flutes arranged side by side across the reflective surface. However, prior art approaches to fabricate such a lamp have, to the knowledge of the present inventor, been unsuccessful due to an inability to configure the surfaces of individual flutes properly to achieve the desired light distribution.

It is a primary object of this invention to provide such a vertically fluted fog lamp reflector with flutes that are configured appropriately so as to disperse light in a pattern appropriate for fog lamps.

SUMMARY OF THE INVENTION

This invention relates to improvements to a lamp reflector of the type comprising a reflector body which defines a reflector surface having at least one convex flute, wherein the reflector body defines a mid-line and the flute is oriented generally transverse to the midline.

According to this invention, each of the flutes comprises a plurality of parallel segments arranged side by side along the lateral direction defined by the midline. The segments of each flute comprise at least one central segment, a plurality of left-of-center segments, and a plurality of right-of-center segments. Each of the segments is shaped as a section of a respective paraboloid having a respective focus, central axis and focal length. All of the focuses substantially coincide at a selected point in space, and the segments of each flute are aimed in a plurality of non-parallel directions with the left-of-center segments of each flute aimed left of the central segments and the right-of-center segments of each flute aimed right of the central segments to laterally disperse reflected light originating at the selected point in space. The focal lengths of the paraboloids increase progressively from one side of at least some of the flutes to the other, and the paraboloids are each scaled about the respective focus to ensure that adjacent segments meet on the midline in a substantially continuous curve.

The preferred embodiment described below is a vehicular fog lamp which collimates light in the vertical direction, while causing reflected light to diverge in the horizontal direction. Since light dispersion is accomplished by the reflector, plain transparent glass can be used for the lens. In fact, it may be inappropriate to call the glass sheet covering the reflector a lens, because it no longer performs any light focusing or dispersing function. This advantage is obtained while providing a fluted reflector surface having a distinctive appearance that may provide an important contribution to the appearance of the vehicle.

The invention itself, together with further objects and attendant advantages, will best be understood by reference to the following detailed description, taking in conjunction with the accompanying drawings.

DETAILED DESCRIPTION OF THE PRESENTLY PREFERRED EMBODIMENTS

Figure 10:
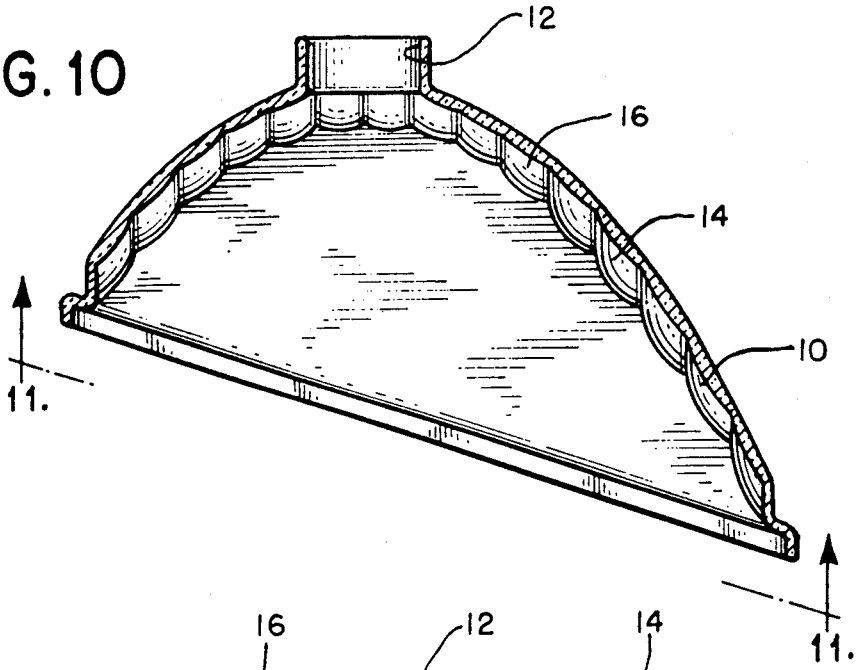
FIG. 10 is a cross sectional view taken through the midline of a reflector which incorporates the reflector surface of FIGS. 8 and 9.
Figure 11:
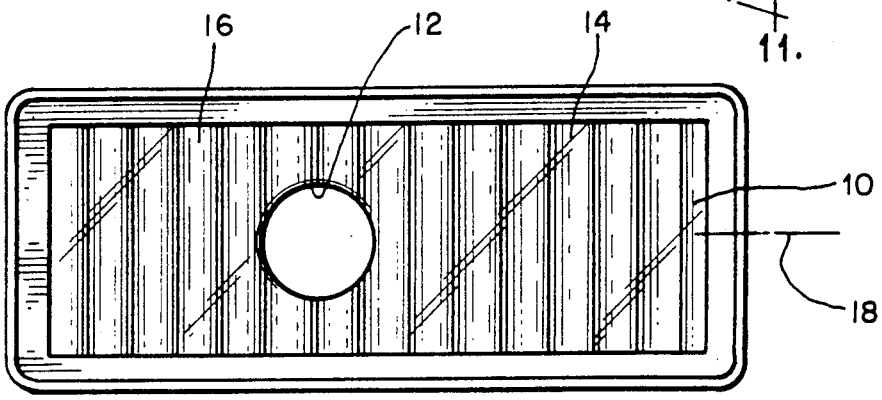
FIG. 11 is a front view taken along lines 11—11 of FIG. 10.

FIGS. 10 and 11 show a lamp reflector 10 having a reflector surface 14 extending around an aperture 12 intended to receive an incandescent bulb (not shown). The reflector surface 14 is made up of a parallel array of convex flutes 16. The reflector 10 is intended to function as a fog lamp for a vehicle, and in this embodiment the flutes 16 are intended to be oriented vertically in use, transverse to the midline 18 of the reflector 10. In this embodiment the reflector 10 has a rectangular appearance when seen from the front (FIG. 11), but other shapes including circular shapes will be suitable for other applications. Simply by way of example, in this embodiment the reflector 10 when seen from the front is approximately 15 cm in width, and each of the convex flutes 16 is approximately 1 cm in width.

Each of the flutes 16 is convex in shape, and according to this invention each of the flutes 16 is made up of a plurality of individual segments. Each of the segments is formed as a section from a respective paraboloid aimed in a respective direction. In this embodiment, each of the flutes 16 include segments aimed to direct light throughout the region from 18° to −18° from the optical axis of the reflector. FIGS. 1-9 will be used to describe in detail the configuration of the segments of this embodiment and how they are chosen.

Figure 1:
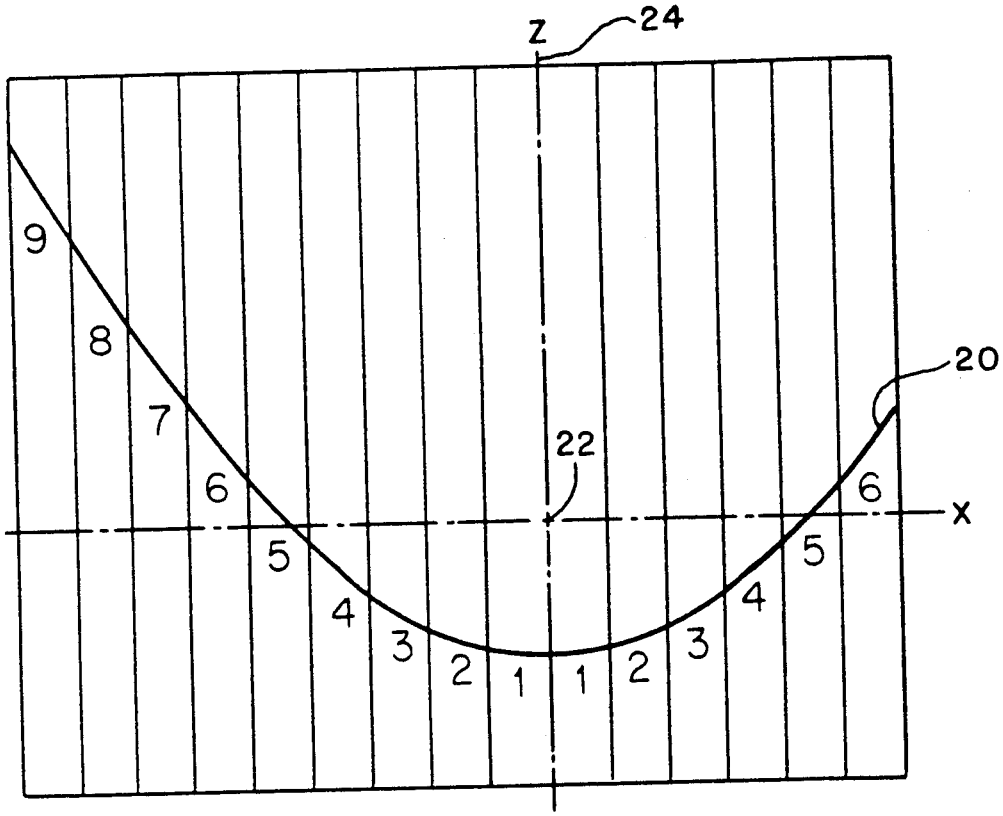
FIG. 1 is a schematic representation of a base parabola used in the design of the presently preferred embodiment of the reflector of this invention.

FIG. 1 is a schematic representation of a parabola 20 that defines the basic shape of the reflector surface 14 at the midline 18, before the flutes 16 are formed. The focus of the parabola 20 is indicated at reference symbol 22 and the central axis at reference symbol 24. In the following discussion the plane of FIG. 1 will be referred to as the X-Z plane, where the Z axis is along the central axis 24, and the X and Z axes intersect at the focus 22, FIGS. 1-5 are drawn in the X-Z plane.

As shown in FIG. 1, the parabola 20 is divided into fifteen sections labelled 1-9 on the left of the central axis 24 and 1-6 on the right of the central axis 24. In general, the parabola 20 and the reflector surface 14 are symmetrical about the central axis 24, and sections bearing the same number have the same shape. The following discussion will therefore focus entirely on Sections 1-9 to the left of the central axis 24. In this embodiment each of the Sections 1-9, 1-6 is one centimeter in width, and each corresponds substantially to a flute as described below.

Figure 2:
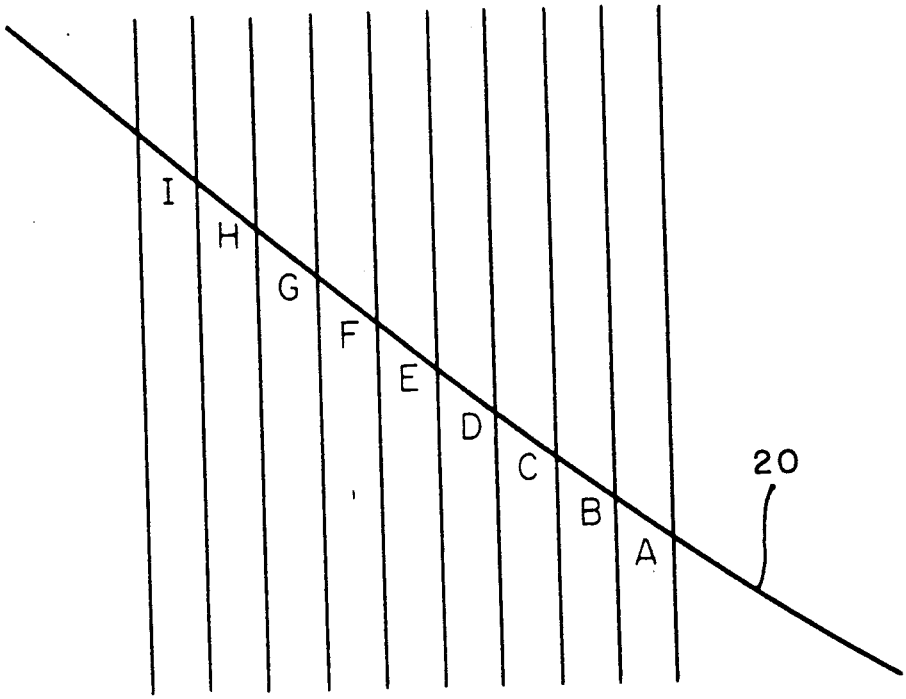
FIG. 2 is an enlarged view of Section 4 of FIG. 1, showing individual segments.

FIG. 2 shows an expanded view of a portion of the parabola 20 at Section 4. As shown in FIG. 2, Section 4 is divided for analytical reasons into nine segments labelled A-I. In this embodiment Segment E is the central segment, Segments A-D are right-of-center segments and Segments F-I are left-of-center segments. In the following discussion on occasion segment A will be referred to as the extreme right-of-center segment and segment I will be referred to as the extreme left-of-center segment. Of course, these relationships are reversed when dealing with the right hand side of the parabola 20.

In order to define the flutes 16 at the mid-line 18, each of the Sections 1-9, 1-6 is modified to provide it with a convex shape that disperses light over the desired range (±18° from the central axis 24 in this embodiment).

Figure 4:
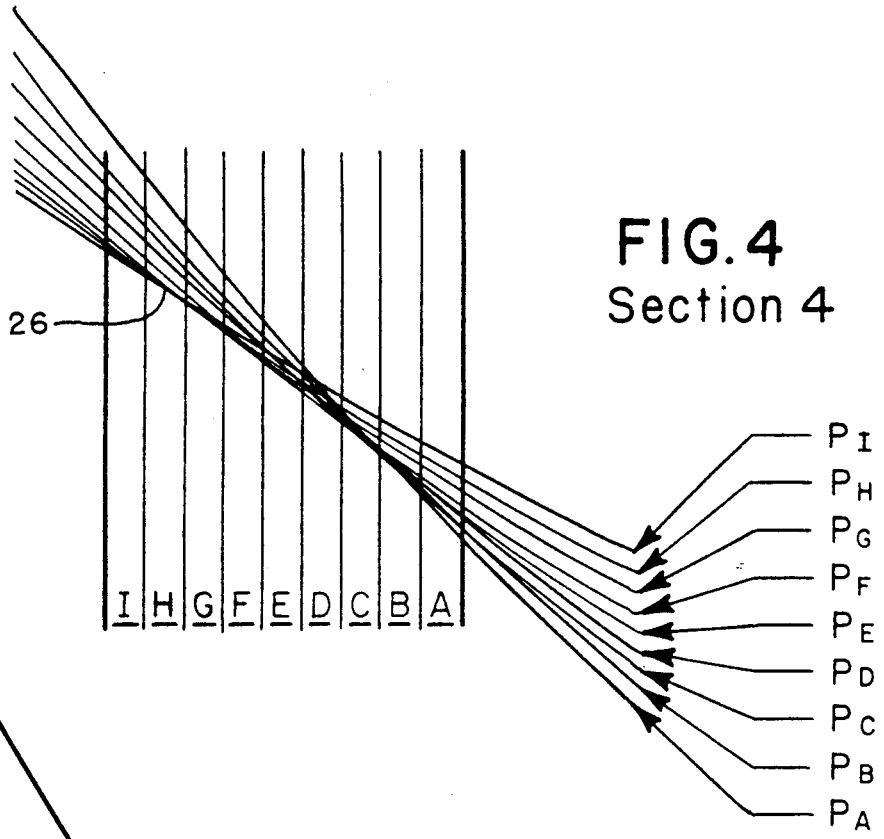
FIG. 4 shows a subsequent stage in the design of the preferred embodiment of this invention, in which the parabolas of FIG. 3 have been scaled to eliminate discontinuities at their junctions on the midline of the reflector.
Figure 3:
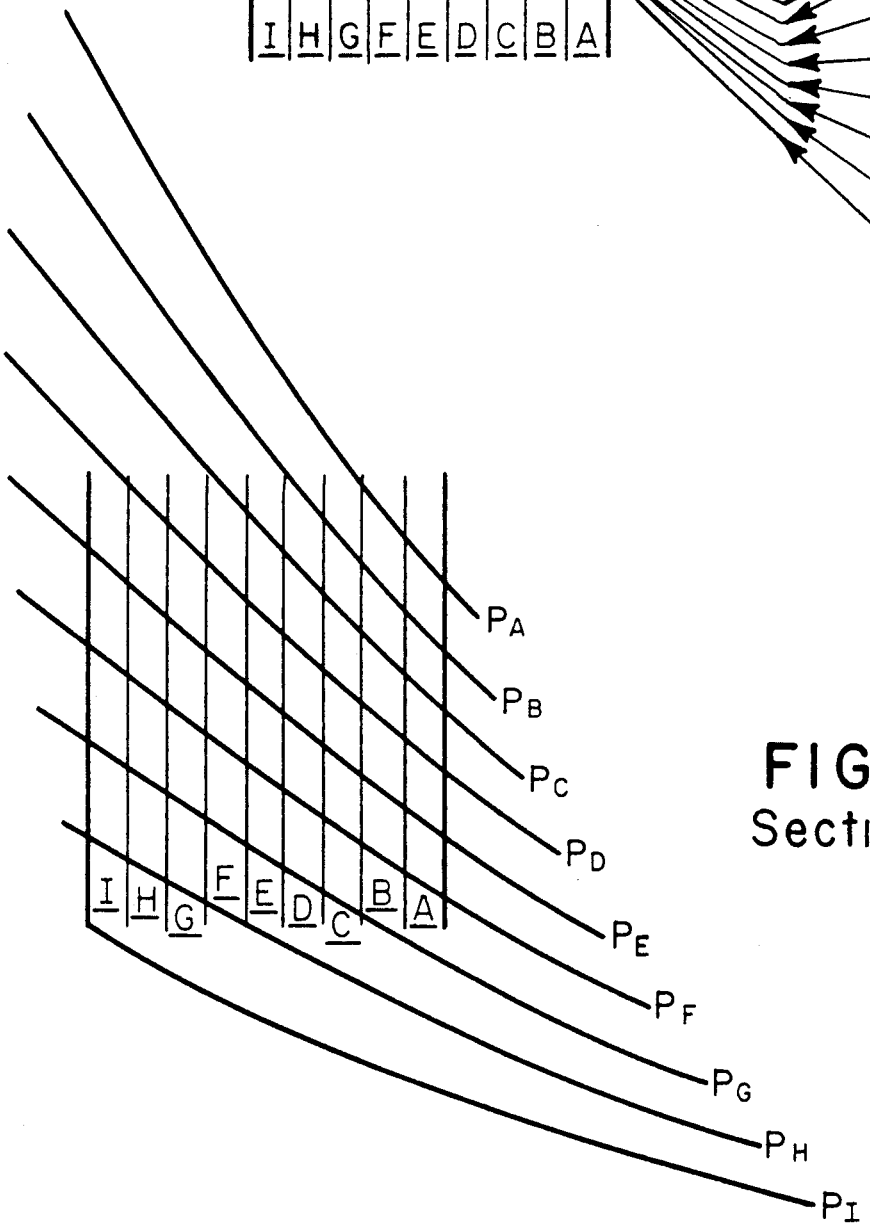
FIG. 3 shows a further stage in the design of the preferred embodiment of this invention, in which parabolas passing through the individual segments of Section 4 have been rotated with respect to one another.

This is preferably done within each section on a segment by segment basis by first rotating the parabola 20 about the focus 22 as shown in FIG. 3. In FIG. 3, the central Segment E is left unrotated, and the Segments A, B, C and D are rotated clockwise by 18°, 13.5°, 9°, and 4.5°, respectively, to form rotated parabolas $P_A$-$P_D$. Similarly, in FIG. 3 the Segments F, G, H and I are rotated counterclockwise from the original position of the parabola 20 by 4.5°, 9°, 13.5° and 18°, respectively, to form rotated parabolas $P_F$-$P_I$. As apparent from FIG. 3, the parabolas $P_A$-$P_I$ do not meet at the lines between adjacent segments A-I. In order to obtain the desired continuous surface for each of the flutes, the parabolas $P_A$-$P_I$ are scaled with respect to the fixed focus as shown in FIG. 4. In effect, the focal lengths of the parabolas $P_A$-$P_D$ are increased and the focal lengths of the parabolas $P_F$-$P_I$ are decreased, in each case by an amount sufficient to ensure that adjacent parabolas $P_A$-$P_I$ intersect at the previously defined border between adjacent segments A-I. This is preferably done on a computer-aided engineering (CAE) workstation using a trial and error iteration technique. It has been found that using conventional CAE techniques the parabolas $P_A$-$P_I$ in adjacent segments can be made to match at the intersection between adjacent segments to within one micron.

By way of example, in this process the parabola $P_E$ in Segment E is left unchanged. In order to determine the contour of Segment F the parabola $P_F$ is scaled by reducing its focal length until the parabola $P_F$ meets the parabola $P_E$ at the line between Segments E and F. This process is repeated for each of the Segments A-I of each of the Sections 1-9.

Figure 5:
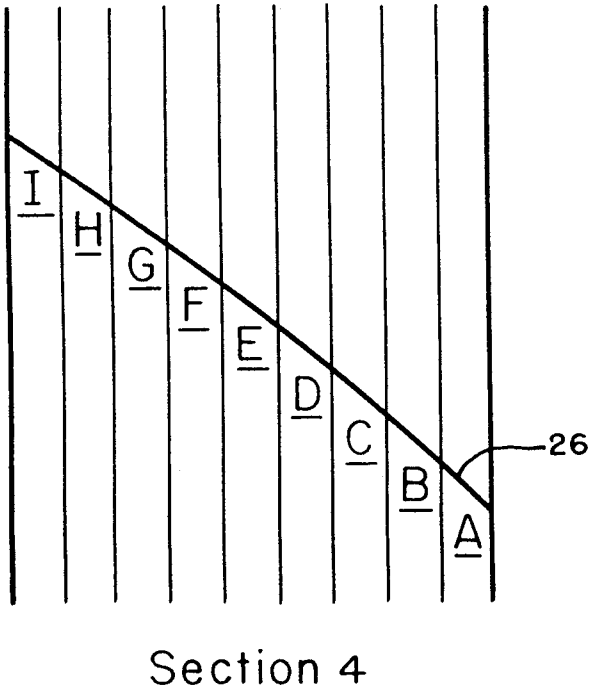
FIG. 5 is a cross sectional view of Section 4 as defined by the intersecting parabolas of FIG. 4.

FIG. 4 shows an intermediate stage of design in which the parabolas $P_A$-$P_I$ have been rotated and scaled such that they intersect to form a convex curve across Section 4. This convex curve is indicated at reference symbol 26. It is this curve 26 that forms the convex shape of the flute in the X-Z plane where Section 4 intersects the midline 18. FIG. 5 shows the finished contour of Section 4, which was determined as described above.

Once each of the sections 1-9 has been defined at the midline 18 as described above, it remains to fine tune the intersection between adjacent sections to eliminate any discontinuities. This is again preferably done on a CAE workstation by moving the intersection line between adjacent sections to a point where the parabola $P_A$ of Segment A of one section intersects the parabola $P_I$ of Segment I of the adjacent section. It has been found that this approach can be used to eliminate discontinuities without substantially altering the position of the border between adjacent sections.

Table 1 defines each of the segments A–I of each of the sections 1–9 of the presently preferred embodiment of this invention. Table 1 shows, for each segment of each section, three variables: X, theta, and focal length. In Table 1, X is the position of the inner (i.e. closer to the optical axis 24) edge of the segment on the X axis, measured in millimeters from the central axis 24. Theta is the aiming angle of the segment and varies between 18° to the right of the central axis 24 (plus 18°) and 18° to the left of the central axis 24 (minus 18°). Finally, the focal length defined in Table 1 is the focal length in millimeters of the paraboloid that defines the respective segment of the respective section.

Figure 6:
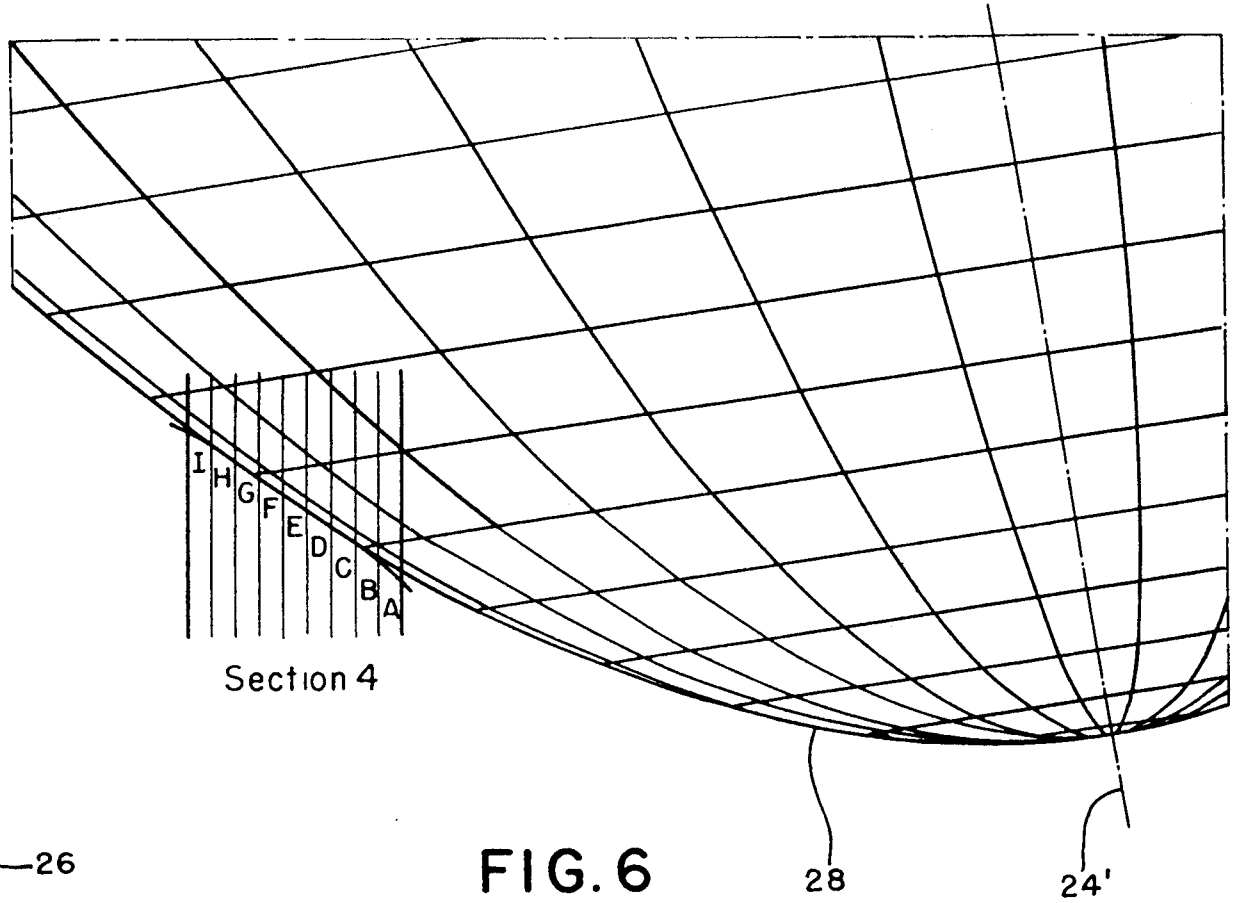
FIG. 6 is a perspective view showing the manner in which Segment G of Section 4 is part of a paraboloid of revolution.

Returning to the drawings, the next step in designing the reflector surface 14 is to form a paraboloid of revolution for each of the segments of each of the sections. FIG. 6 shows such a paraboloid of revolution 28 for Segment G of Section 4. The paraboloid of revolution 28 is symmetrical about the center line 24' of the rotated parabola $P_A$–$P_I$ that defines the respective segment.

Figure 7:
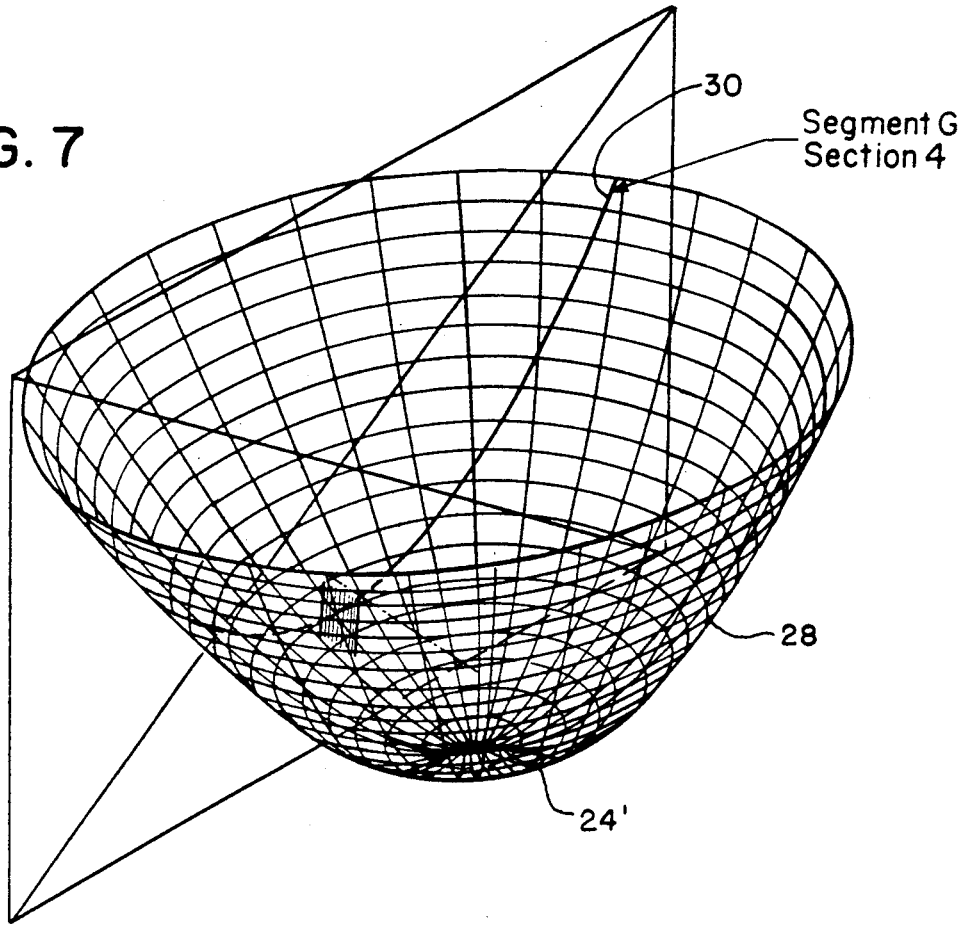
FIG. 7 shows a section plane through the paraboloid of revolution of FIG. 6, and illustrates in three dimensions Segment G of Section 4 of the preferred embodiment of this invention.

FIG. 7 shows an alternate view of the paraboloid 28 corresponding to Segment G of Section 4. As the next step in design, a section is taken through each of the paraboloids 28. This section is oriented in a Y-Z plane, parallel to the central axis 24 of the reflector surface 14, and is therefore tilted with respect to the central axis 24' of the paraboloid 28. The intersection between the section plane and the paraboloid 28 is a curve 30 that defines the contour of the inner edge of the respective segment in three dimensions.

Figure 8:
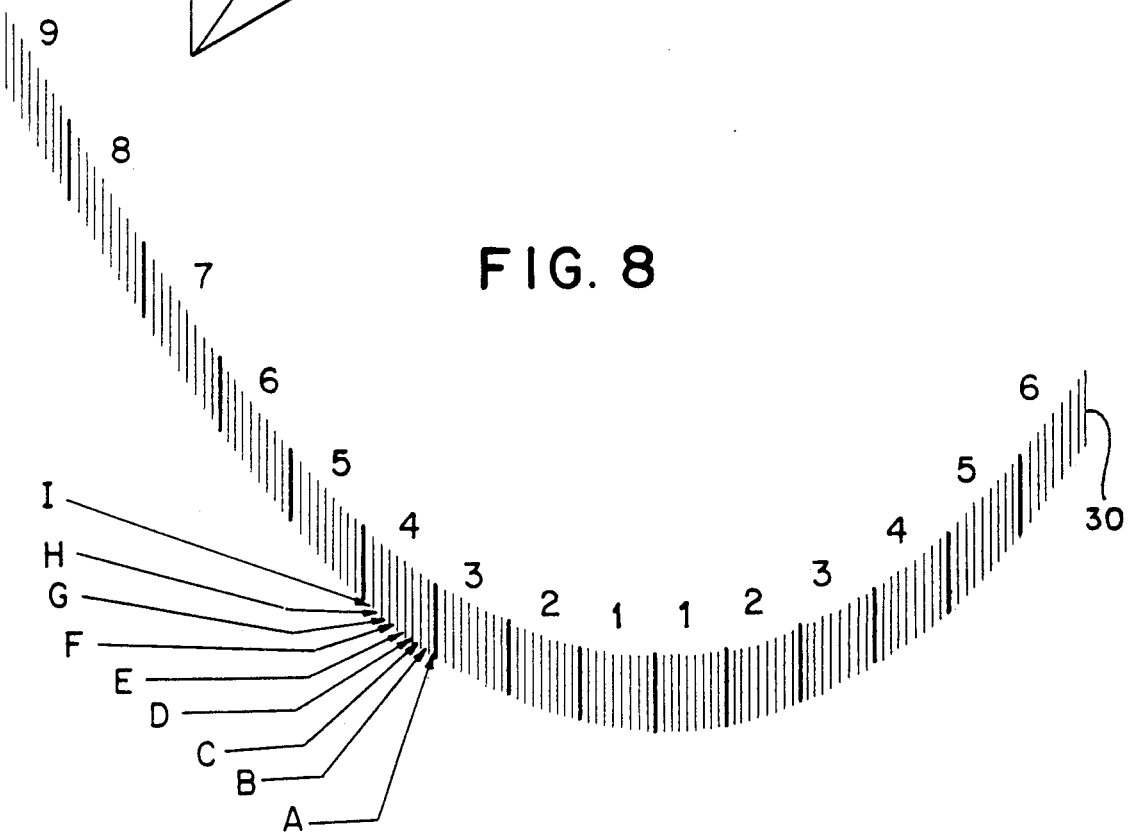
FIG. 8 is a wire frame drawing of each of the segments of the preferred embodiment of this invention, showing the embodiment from the side.
Figure 9:
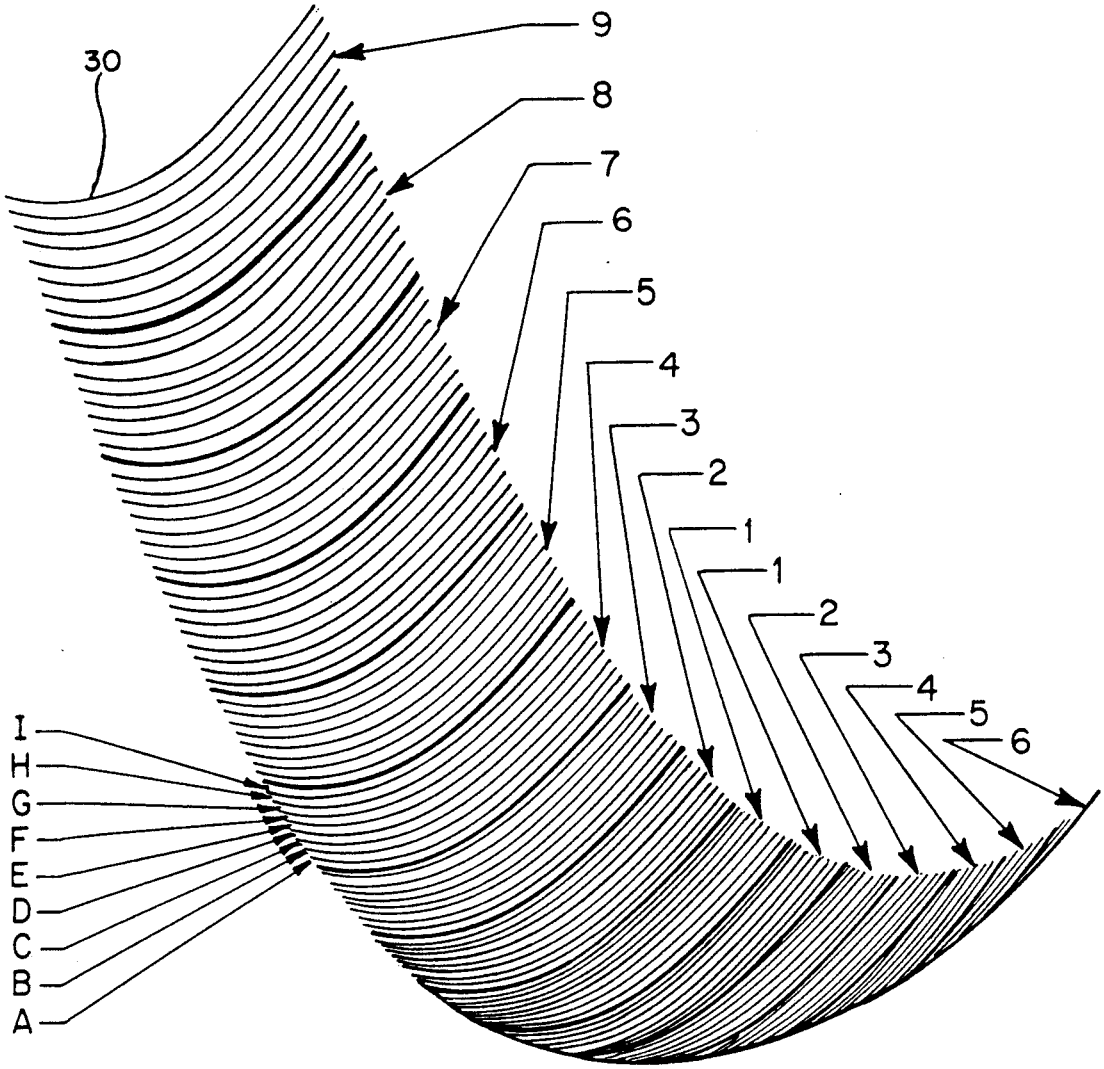
FIG. 9 is another wire frame drawing of the preferred embodiment of this invention.

FIGS. 8 and 9 are wire frame drawings showing perspective views of the reflector surface 14. Each of the lines 30 in the wire frame drawings of FIGS. 8 and 9 is defined by the intersection between a respective paraboloid 28 and a respective section plane as described above in conjunction with FIG. 7.

It has been discovered that when segments are defined as described above, adjacent segments are substantially matched in position along their entire vertical intersection with one another, and a reflective surface can be thereby defined which defines cusps between adjacent flutes 16, but which otherwise provides generally smoothly rounded convex surfaces for the flutes 16.

In view of the foregoing, it should be apparent that each of the segments is defined by a section through a paraboloid of revolution, and that all of the paraboloids have a common focus, situated at the center of the filament of the intended lamp (not shown). Furthermore, each of these paraboloids has a respective central axis, and these central axes are rotated with respect to the central axis 24 of the reflector surface 14, except for the paraboloids which define the central segments (which are left unrotated). Furthermore, each of the paraboloids defines a respective focal length, and within each of the flutes the focal lengths of the paraboloids of revolution are progressively greater the nearer the segment is to the central axis 24 of the reflector surface 14. As a limited exception to the foregoing statement, Table 1 shows that the two innermost Segments A and B of the innermost Section 1 deviate from this rule. However, the rule applies to the remaining sections, and it substantially applies to the innermost Sections 1 as well.

With this arrangement, the focuses of all of the paraboloids that define all of the segments of all of the sections coincide in space, and the reflector 10 therefore provides excellent vertical collimation. Since the segments within each flute are aimed at different aiming angles to the left and right of center, each of the sections (i.e. each of the flutes 16) distributes light over the entire intended lateral range. Because the paraboloids are scaled properly, adjacent segments meet at the midline 18 on a substantially continuous curve. Of course, in practice the lamp filament will have a finite dimension, and will assist in smoothing the light distribution.

FIGS. 8 and 9 show Segments A–I for Section 4. From Table 1, it will be apparent that Segments A, C, E, G, and I of Section 4 (and of each of the other Sections 1–3, 5–9) are aimed at about the following aiming angles $\theta$:

$\theta_A = +18°$;

$\theta_C = +9°$;

$\theta_E = 0°$;

$\theta_G = -9°$;

$\theta_I = -18°$.

Table 1 lists the focal lengths of each of the Segments A–I in each of the Sections 1–9. As also shown in Table 1, the ratio of the maximum focal length to the minimum focal length ($F_{MAX}/F_{MIN}$) is equal to the following values for the respective sections:

| Section No. | $F_{MAX}/F_{MIN}$ |
|---|---|
| Section 1 | 1.09 |
| Section 2 | 1.24 |
| Section 3 | 1.43 |
| Section 4 | 1.66 |
| Section 5 | 1.92 |
| Section 6 | 2.23 |
| Section 7 | 2.58 |
| Section 8 | 3.01 |
| Section 9 | 3.52 |

From this table it is clear that the ratio $F_{MAX}/F_{MIN}$ for an intermediate flute is greater than the ratio for an innermore flute and less than the ratio for an outermore flute. For example, the ratios $F_{MAX}/F_{MIN}$ for the inner, intermediate, and outer flutes 1, 3, 6 are equal to 1.1, 1.4, and 2.2, respectively. In general, the ratio $F_{MAX}/F_{MIN}$ is progressively greater for flutes progressively nearer an outer edge of the reflector surface.

Figure 12:
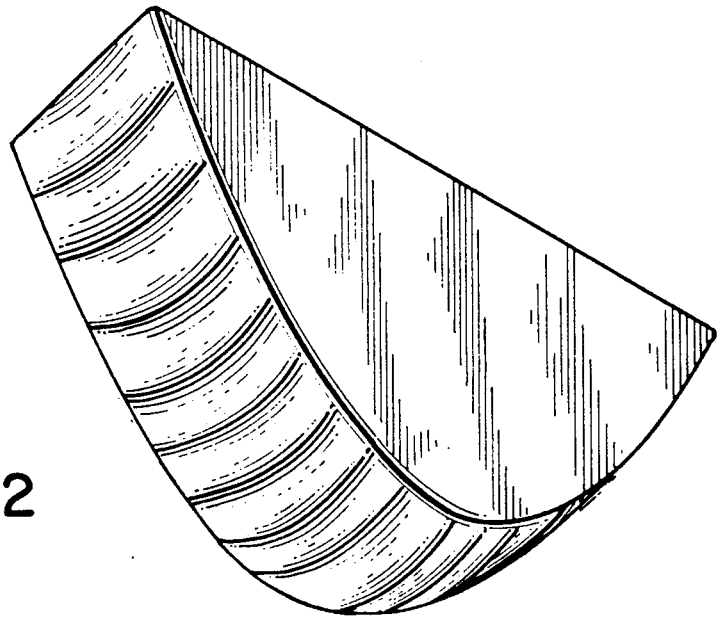
FIG. 12 is a perspective view of a male core used to form the reflector of FIG. 10.

The final data generated by the CAE program (which defines the lines 30 of the wire frame diagrams of FIGS. 8 and 9 using the parameters of Table 1) is then used to cut a male core with a ball mill in the desired final shape of the reflector surface 14. It produces a male core 32 generally as shown in FIG. 12. Preferably, the male core is formed from a block of pre-hardened steel. Alternately, softer steels can be used which are hardened later. Once the male core is machined, it is then polished using conventional techniques to ensure that each of the flutes is visually smooth, and that any lines between adjacent sections within a flute are made invisible. Once the male core is formed, it is then used to mold or otherwise form the final reflector body 12. The reflector body 12 can be die cast, injection molded from plastic, or drawn from sheet metal. In the preferred embodiment, the reflector body 12 is injection molded from plastic and then coated with a reflecting material such as aluminum.

It is important to note that the curvature of each of the flutes is not constant, but instead varies smoothly along the length of the flute. At a distance from the midline, a flute may become flattened or even concave in cross section. This axial non-uniformity along the length of the flutes is believed to contribute to the optical performance of the reflector.

Of course, the present invention can be adapted to lamps of other shapes (such as rounded shapes) and to lamps other than fog lamps. The aiming angles and focal lengths of the individual segments can be altered as appropriate for the particular application. For example, the widths of individual segments within a flute can be altered as necessary to alter the lateral distribution of reflected light. Furthermore, it is not essential in all embodiments that each of the flutes disperse light over the entire lateral range of the reflector 10. For example, it may be preferred in some embodiments to cause the innermost Sections 1 and 2 to disperse light over a broader angular range (such as ±22°) while the outer Sections 7, 8 and 9 disperse light over a narrower lateral range (such as ±18°, ±17°, ±16°). Table 2 lists the geometrical parameters of one such alternative, expressed in the same parameters as Table 1. In this way, light can be concentrated in a central portion of the lateral range of the reflector 10, yet some light can be dispersed through larger angles.

In addition, the design process described above is preferred, but other approaches are possible. For example, the equatorial section of the reflector 10 can be chosen as other desired curves, such as ellipses, and segments passing through this curve can then be selected.

It is therefore intended that the foregoing detailed description be regarded as illustrative rather than limiting, and that it be understood that it is the following claims, including all equivalents, which are intended to define the scope of this invention.

I claim:

1. In a lamp reflector of the type comprising a reflector body which defines a reflector surface having at least one convex flute, said reflector body defining a midline, and said at least one flue oriented generally transverse to the midline, the improvement comprising:

a plurality of parallel segments included in each of the flutes and arranged side by side along a lateral direction defined by the midline, the segments of each flute comprising at least one central segment, a plurality of left-of-center segments, and a plurality of right-of-center segments, wherein each of said segments is shaped as a section of a respective paraboloid having a respective focus, central axis and focal length;

wherein all of the focuses substantially coincide at a selected point in space;

wherein the segments of each flute are aimed in a plurality of non-parallel directions with the left-of-center segments of each flute aimed left of the central segments and the right-of-center segments of each flute aimed right of the central segments to laterally disperse reflected light originating at the selected point in space;

wherein the focal lengths of the paraboloids increase progressively from one side to the other side of at least some of the flutes;

wherein the paraboloids are each scaled about the respective focus to ensure that adjacent segments meet on the midline in a substantially continuous curve; and wherein each of the flutes is convex as viewed from the selected point in space at which all of the focusses substantially coincide.

2. The invention of claim 1 wherein the at least one flute comprises a plurality of parallel flutes.

3. The invention of claim 2 wherein the reflector body is substantially rectangular.

4. The invention of claim 2 wherein each of the segments defines a width no greater than about 1 mm, and wherein each of the flutes defines a width no greater than about 1 cm.

5. The invention of claim 2 wherein, for each flute, the central axes of the paraboloids corresponding to the extreme left-of-center segment and the extreme right-of-center segment are angled at least 15° left and at least 15° right, respectively, of the central axis of the paraboloids corresponding to the central segments.

6. The invention of claim 2 wherein the central axes of the paraboloids corresponding to the extreme left-of-center segment of each flute diverge by substantially the same amount, such that light reflected from each flute is directed over an entire lateral range illuminated by the reflector.

7. The invention of claim 2 wherein the central axes of the paraboloids corresponding to adjacent segments within one of the flutes diverge from one another at one angle of about 4½°.

8. The invention of claim 2 wherein the plurality of segments in each flute comprises at least five equally spaced segments A, C. E, G, I, wherein E is the central segment. A is the extreme right-of-center segment, and I is the extreme left-of-center segment, and wherein the segments A, C, E, G, I are aimed at substantially the following angles $\theta_A$, $\theta_C$, $\theta_E$, $\theta_G$, $\theta_I$ with respect to a central axis:

$$\theta_A = +18°;$$

$$\theta_C = +9°;$$

$$\theta_E = 0°;$$

$$\theta_G = -9°;$$

$$\theta_I = -18°.$$

9. The invention of claim 8 wherein the plurality of segments in the flute comprises a plurality of additional segments interspersed between the segments A, C, E, G, I.

10. The invention of claim 2 wherein the plurality of flutes comprises at least three flutes comprising an outer flute, an intermediate flute and an inner flute on one side of the reflector surface, wherein the segments of each of the flutes comprise segments corresponding to paraboloids having maximum and minimum focal lengths $F_{MAX}$, $F_{MIN}$ within the flute, and wherein the ratio $F_{MAX}/F_{MIN}$ for the intermediate flute is greater than the ratio $F_{MAX}/F_{MIN}$ for the inner flute and less than the ratio $F_{MAX}/F_{MIN}$ for the outer flute.

11. The invention of claim 10 wherein the ratio $F_{MAX}/F_{MIN}$ for the inner, intermediate and outer flutes is about 1.1, 1.4 and 2.2, respectively.

12. The invention of claim 10 wherein the ratio $F_{MAX}/F_{MIN}$ is progressively greater for flutes progressively nearer an outer edge of the reflector surface.

13. The invention of claim 10 wherein the segments of each flute comprise at least five segments A, C, E, G, I which are aimed at substantially the following angles $\theta_A$, $\theta_C$, $\theta_E$, $\theta_G$, $\theta_I$, respectively:

$\theta_A = +18°$;

$\theta_C = +9°$;

$\theta_E = 0°$;

$\theta_G = -9°$;

$\theta_I = -18°$.

* * * * *

UNITED STATES PATENT AND TRADEMARK OFFICE

CERTIFICATE OF CORRECTION

PATENT NO. : 5,034,867

DATED : July 23, 1991

INVENTOR(S) : Mark J. Mayer

It is certified that error appears in the above-identified patent and that said Letters Patent is hereby corrected as shown below:

On the title page under the heading "Inventor", please delete "Boling Brook" and substitute therefor --Bolingbrook--.

In column 3, line 58, after "22" please delete "," and substitute therefor --.--.

In column 6, line 54, after "14." please delete "It" and substitute therefor --Preferably the ball mill has a diameter of 12-8 mm, and it--.

Column 7 line 40 insert "Table" before " I claim"

TABLE 1

| SECTION | SEGMENT | X | THETA | FOCAL LENGTH | FMAX/FMIN |
|---|---|---|---|---|---|
| 1 | A | 0.000 | 18.0 | 22.111 | 1.09 |
| | B | 1.111 | 13.5 | 22.309 | |
| | C | 2.222 | 9.0 | 22.395 | |
| | D | 3.333 | 4.5 | 22.366 | |
| | E | 4.444 | 0.0 | 22.225 | |
| | F | 5.556 | -4.5 | 21.973 | |
| | G | 6.667 | -9.0 | 21.613 | |
| | H | 7.778 | -13.5 | 21.147 | |
| | I | 8.889 | -18.0 | 20.581 | |

UNITED STATES PATENT AND TRADEMARK OFFICE

CERTIFICATE OF CORRECTION

PATENT NO. : 5,034,867

DATED : July 23, 1991

INVENTOR(S) : Mark J. Mayer

It is certified that error appears in the above-identified patent and that said Letters Patent is hereby corrected as shown below:

TABLE 1 (CONT.)

| SECTION | SEGMENT | X | THETA | FOCAL LENGTH | FMAX/FMIN |
|---|---|---|---|---|---|
| 2 | A | 10.090 | 18.0 | 23.699 | 1.24 |
| | B | 11.111 | 13.5 | 23.504 | |
| | C | 12.222 | 9.0 | 23.190 | |
| | D | 13.333 | 4.5 | 22.763 | |
| | E | 14.444 | 0.0 | 22.225 | |
| | F | 15.556 | -4.5 | 21.585 | |
| | G | 16.667 | -9.0 | 20.847 | |
| | H | 17.778 | -13.5 | 20.017 | |
| | I | 18.889 | -18.0 | 19.107 | |
| 3 | A | 20.152 | 18.0 | 25.334 | 1.43 |
| | B | 21.111 | 13.5 | 24.724 | |
| | C | 22.222 | 9.0 | 23.998 | |
| | D | 23.333 | 4.5 | 23.162 | |
| | E | 24.444 | 0.0 | 22.225 | |
| | F | 25.556 | -4.5 | 21.201 | |
| | G | 26.667 | -9.0 | 20.096 | |
| | H | 27.778 | -13.5 | 18.922 | |
| | I | 28.889 | -18.0 | 17.690 | |

UNITED STATES PATENT AND TRADEMARK OFFICE

CERTIFICATE OF CORRECTION

PATENT NO. : 5,034,867

DATED : July 23, 1991

INVENTOR(S) : Mark J. Mayer

It is certified that error appears in the above-identified patent and that said Letters Patent is hereby corrected as shown below:

TABLE 1 (CONT.)

| SECTION | SEGMENT | X | THETA | FOCAL LENGTH | FMAX/FMIN |
|---|---|---|---|---|---|
| 4 | A | 30.213 | 18.0 | 27.027 | 1.66 |
| | B | 31.111 | 13.5 | 25.976 | |
| | C | 32.222 | 9.0 | 24.817 | |
| | D | 33.333 | 4.5 | 23.563 | |
| | E | 34.444 | 0.0 | 22.225 | |
| | F | 35.556 | -4.5 | 20.819 | |
| | G | 36.667 | -9.0 | 19.356 | |
| | H | 37.778 | -13.5 | 17.852 | |
| | I | 38.889 | -18.0 | 16.323 | |
| 5 | A | 40.294 | 18.0 | 28.774 | 1.92 |
| | B | 41.111 | 13.5 | 27.260 | |
| | C | 42.222 | 9.0 | 25.653 | |
| | D | 43.333 | 4.5 | 23.968 | |
| | E | 44.444 | 0.0 | 22.225 | |
| | F | 45.556 | -4.5 | 20.438 | |
| | G | 46.667 | -9.0 | 18.630 | |
| | H | 47.778 | -13.5 | 16.815 | |
| | I | 48.889 | -18.0 | 15.013 | |

UNITED STATES PATENT AND TRADEMARK OFFICE

CERTIFICATE OF CORRECTION

PATENT NO. : 5,034,867

DATED : July 23, 1991

INVENTOR(S) : Mark J. Mayer

It is certified that error appears in the above-identified patent and that said Letters Patent is hereby corrected as shown below:

TABLE 1 (CONT.)

| SECTION | SEGMENT | X | THETA | FOCAL LENGTH | FMAX/FMIN |
|---|---|---|---|---|---|
| 6 | A | 50.375 | 18.0 | 30.579 | 2.23 |
| | B | 51.111 | 13.5 | 28.577 | |
| | C | 52.222 | 9.0 | 26.504 | |
| | D | 53.333 | 4.5 | 24.379 | |
| | E | 54.444 | 0.0 | 22.225 | |
| | F | 55.556 | -4.5 | 20.066 | |
| | G | 56.667 | -9.0 | 17.920 | |
| | H | 57.778 | -13.5 | 15.811 | |
| | I | 58.889 | -18.0 | 13.757 | |
| 7 | A | 60.429 | 18.0 | 32.430 | 2.58 |
| | B | 61.111 | 13.5 | 29.922 | |
| | C | 62.222 | 9.0 | 27.367 | |
| | D | 63.333 | 4.5 | 24.792 | |
| | E | 64.444 | 0.0 | 22.225 | |
| | F | 65.556 | -4.5 | 19.694 | |
| | G | 66.667 | -9.0 | 17.224 | |
| | H | 67.778 | -13.5 | 14.837 | |
| | I | 68.889 | -18.0 | 12.558 | |

UNITED STATES PATENT AND TRADEMARK OFFICE

CERTIFICATE OF CORRECTION

PATENT NO. : 5,034,867

DATED : July 23, 1991

INVENTOR(S) : Mark J. Mayer

It is certified that error appears in the above-identified patent and that said Letters Patent is hereby corrected as shown below:

TABLE 1 (CONT.)

| SECTION | SEGMENT | X | THETA | FOCAL LENGTH | FMAX/FMIN |
|---|---|---|---|---|---|
| 8 | A | 70.493 | 18.0 | 34.342 | 3.01 |
| | B | 71.111 | 13.5 | 31.298 | |
| | C | 72.222 | 9.0 | 28.242 | |
| | D | 73.333 | 4.5 | 25.207 | |
| | E | 74.444 | 0.0 | 22.225 | |
| | F | 75.556 | -4.5 | 19.327 | |
| | G | 76.667 | -9.0 | 16.540 | |
| | H | 77.778 | -13.5 | 13.893 | |
| | I | 78.889 | -18.0 | 11.411 | |
| 9 | A | 80.580 | 18.0 | 36.312 | 3.52 |
| | B | 81.111 | 13.5 | 32.709 | |
| | C | 82.222 | 9.0 | 29.135 | |
| | D | 83.333 | 4.5 | 25.627 | |
| | E | 84.444 | 0.0 | 22.225 | |
| | F | 85.556 | -4.5 | 18.963 | |
| | G | 86.667 | -9.0 | 15.871 | |
| | H | 87.778 | -13.5 | 12.981 | |
| | I | 88.889 | -18.0 | 10.322 | |

UNITED STATES PATENT AND TRADEMARK OFFICE

CERTIFICATE OF CORRECTION

PATENT NO. : 5,034,867

DATED : July 23, 1991

INVENTOR(S) : Mark J. Mayer

It is certified that error appears in the above-identified patent and that said Letters Patent is hereby corrected as shown below:

TABLE 2

| SECTION | SEGMENT | X | THETA | FOCAL LENGTH | FMAX/FMIN |
|---|---|---|---|---|---|
| 1 | A | 0.000 | 22.0 | 21.944 | 1.11 |
| | B | 1.111 | 16.5 | 22.250 | |
| | C | 2.222 | 11.0 | 22.399 | |
| | D | 3.333 | 5.5 | 22.387 | |
| | E | 4.444 | 0.0 | 22.225 | |
| | F | 5.556 | -5.5 | 21.912 | |
| | G | 6.667 | -11.0 | 21.449 | |
| | H | 7.778 | -16.5 | 20.848 | |
| | I | 8.889 | -22.0 | 20.097 | |
| 2 | A | 10.080 | 22.0 | 23.873 | 1.30 |
| | B | 11.111 | 16.5 | 23.703 | |
| | C | 12.222 | 11.0 | 23.367 | |
| | D | 13.333 | 5.5 | 22.736 | |
| | E | 14.444 | 0.0 | 22.225 | |
| | F | 15.556 | -5.5 | 21.435 | |
| | G | 16.667 | -11.0 | 20.521 | |
| | H | 17.778 | -16.5 | 19.480 | |
| | I | 18.889 | -22.0 | 18.334 | |

CERTIFICATE OF CORRECTION

PATENT NO. : 5,034,867

DATED : July 23, 1991

INVENTOR(S) : Mark J. Mayer

It is certified that error appears in the above-identified patent and that said Letters Patent is hereby corrected as shown below:

TABLE 2 (CONT.)

| SECTION | SEGMENT | X | THETA | FOCAL LENGTH | FMAX/FMIN |
|---|---|---|---|---|---|
| 3 | A | 20.156 | 22.0 | 25.884 | 1.56 |
| | B | 21.111 | 16.5 | 25.204 | |
| | C | 22.222 | 11.0 | 24.361 | |
| | D | 23.333 | 5.5 | 23.362 | |
| | E | 24.444 | 0.0 | 22.225 | |
| | F | 25.556 | -5.5 | 20.970 | |
| | G | 26.667 | -11.0 | 19.608 | |
| | H | 27.778 | -16.5 | 18.160 | |
| | I | 28.889 | -22.0 | 16.643 | |
| 4 | A | 30.204 | 21.0 | 27.754 | 1.81 |
| | B | 31.111 | 15.75 | 26.570 | |
| | C | 32.222 | 10.5 | 25.242 | |
| | D | 33.333 | 5.25 | 23.785 | |
| | E | 34.444 | 0.0 | 22.225 | |
| | F | 35.556 | -5.25 | 20.582 | |
| | G | 36.667 | -10.5 | 18.875 | |
| | H | 37.778 | -15.75 | 17.126 | |
| | I | 38.889 | -21.0 | 15.353 | |

CERTIFICATE OF CORRECTION

PATENT NO. : 5,034,867

DATED : July 23, 1991

INVENTOR(S) : Mark J. Mayer

It is certified that error appears in the above-identified patent and that said Letters Patent is hereby corrected as shown below:

TABLE 2 (CONT.)

| SECTION | SEGMENT | X | THETA | FOCAL LENGTH | FMAX/FMIN |
|---|---|---|---|---|---|
| 5 | A | 40.298 | 20.0 | 29.480 | 2.07 |
| | B | 41.111 | 15.0 | 27.815 | |
| | C | 42.222 | 10.0 | 26.032 | |
| | D | 43.333 | 5.0 | 24.164 | |
| | E | 44.444 | 0.0 | 22.225 | |
| | F | 45.556 | -5.0 | 20.243 | |
| | G | 46.667 | -10.0 | 18.233 | |
| | H | 47.778 | -15.0 | 16.228 | |
| | I | 48.889 | -20.0 | 14.248 | |
| 6 | A | 50.363 | 19.0 | 31.044 | 2.33 |
| | B | 51.111 | 14.25 | 28.935 | |
| | C | 52.222 | 9.5 | 26.743 | |
| | D | 53.333 | 4.75 | 24.500 | |
| | E | 54.444 | 0.0 | 22.225 | |
| | F | 55.556 | -4.75 | 19.949 | |
| | G | 56.667 | -9.5 | 17.689 | |
| | H | 57.778 | -14.25 | 15.477 | |
| | I | 58.889 | -19.0 | 13.329 | |

UNITED STATES PATENT AND TRADEMARK OFFICE

CERTIFICATE OF CORRECTION

PATENT NO. : 5,034,867

DATED : July 23, 1991

INVENTOR(S) : Mark J. Mayer

It is certified that error appears in the above-identified patent and that said Letters Patent is hereby corrected as shown below:

TABLE 2 (CONT.)

| SECTION | SEGMENT | X | THETA | FOCAL LENGTH | FMAX/FMIN |
|---|---|---|---|---|---|
| 7 | A | 60.403 | 18.0 | 32.446 | 2.58 |
| | B | 61.111 | 13.5 | 29.933 | |
| | C | 62.222 | 9.0 | 27.370 | |
| | D | 63.333 | 4.5 | 24.793 | |
| | E | 64.444 | 0.0 | 22.225 | |
| | F | 65.556 | -4.5 | 19.692 | |
| | G | 66.667 | -9.0 | 17.220 | |
| | H | 67.778 | -13.5 | 14.832 | |
| | I | 68.889 | -18.0 | 12.552 | |
| 8 | A | 70.464 | 17.0 | 33.655 | 2.82 |
| | B | 71.111 | 12.75 | 30.782 | |
| | C | 72.222 | 8.5 | 27.901 | |
| | D | 73.333 | 4.25 | 25.039 | |
| | E | 74.444 | 0.0 | 22.225 | |
| | F | 75.556 | -4.25 | 19.484 | |
| | G | 76.667 | -8.5 | 16.840 | |
| | H | 77.778 | -12.75 | 14.317 | |
| | I | 78.889 | -17.0 | 11.936 | |

CERTIFICATE OF CORRECTION

PATENT NO. : 5,034,867

DATED : July 23, 1991

INVENTOR(S) : Mark J. Mayer

It is certified that error appears in the above-identified patent and that said Letters Patent is hereby corrected as shown below:

TABLE 2 (CONT.)

| SECTION | SEGMENT | X | THETA | FOCAL LENGTH | FMAX/FMIN |
|---|---|---|---|---|---|
| 9 | A | 80.466 | 16.0 | 34.668 | 3.03 |
| | B | 81.111 | 12.0 | 31.491 | |
| | C | 82.222 | 8.0 | 28.338 | |
| | D | 83.333 | 4.0 | 25.240 | |
| | E | 84.444 | 0.0 | 22.225 | |
| | F | 85.556 | -4.0 | 19.315 | |
| | G | 86.667 | -8.0 | 16.535 | |
| | H | 87.778 | -12.0 | 13.907 | |
| | I | 88.889 | -16.0 | 11.452 | |

UNITED STATES PATENT AND TRADEMARK OFFICE

CERTIFICATE OF CORRECTION

PATENT NO. : 5,034,867

DATED : July 23, 1991

INVENTOR(S) : Mark J. Mayer

It is certified that error appears in the above-identified patent and that said Letters Patent is hereby corrected as shown below:

In claim 1, line 4, please delete "flue" and substitute therefor --flute--.

In claim 8, line 3, please delete "C." and substitute therefor --C,--.

Signed and Sealed this

Twenty-third Day of August, 1994

*Attest:*

*Attesting Officer*

BRUCE LEHMAN

*Commissioner of Patents and Trademarks*